US008329625B2

(12) United States Patent
Rohrbach et al.

(10) Patent No.: US 8,329,625 B2
(45) Date of Patent: Dec. 11, 2012

(54) AQUEOUS FUNCTIONAL FLUIDS WITH ANTIOXIDANTS

(75) Inventors: Peter Rohrbach, Liestal (CH); Samuel Evans, Marly (CH); Stefan Laeuger, Rheinfelden-Degerfelden (DE)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 0 days.

(21) Appl. No.: 12/772,431

(22) Filed: May 3, 2010

(65) Prior Publication Data

US 2010/0213410 A1 Aug. 26, 2010

Related U.S. Application Data

(63) Continuation of application No. 10/496,234, filed as application No. PCT/EP02/12681 on Nov. 13, 2002, now abandoned.

(30) Foreign Application Priority Data

Nov. 21, 2001 (EP) ..... 01811119

(51) Int. Cl.
*C10M 173/02* (2006.01)
*C10M 145/24* (2006.01)
*C10M 145/38* (2006.01)

(52) U.S. Cl. ..... 508/478; 508/579

(58) Field of Classification Search ..... 508/478, 508/579

See application file for complete search history.

(56) References Cited

U.S. PATENT DOCUMENTS

| | | | | |
|---|---|---|---|---|
| 3,441,575 | A * | 4/1969 | Dexter et al. | 554/101 |
| 3,497,549 | A | 2/1970 | Dexter et al. | |
| 3,944,594 | A | 3/1976 | Kleiner et al. | |
| 4,032,562 | A * | 6/1977 | Dexter et al. | 560/75 |
| 4,138,346 | A | 2/1979 | Nassry et al. | |
| 4,151,059 | A | 4/1979 | Kuehnle | |
| 4,209,414 | A * | 6/1980 | Holgado et al. | 252/75 |
| 4,686,058 | A | 8/1987 | Schwartz et al. | |
| 4,716,244 | A | 12/1987 | Orban | |
| 5,137,980 | A | 8/1992 | DeGonia et al. | |
| 5,478,875 | A | 12/1995 | Dubs et al. | |
| 5,531,911 | A | 7/1996 | Adams et al. | |
| 5,696,281 | A | 12/1997 | Evans | |
| 5,739,341 | A | 4/1998 | Dubs et al. | |

FOREIGN PATENT DOCUMENTS

| | | | |
|---|---|---|---|
| EP | 0565487 | A2 | 10/1993 |
| GB | 1376482 | A | 12/1974 |
| JP | 47002211 | A | 2/1972 |
| JP | 48016881 | A | 3/1973 |
| JP | 58029898 | A | 2/1983 |
| JP | 61103995 | A | 5/1986 |
| JP | 61254540 | A | 11/1986 |
| JP | 08239683 | A | 9/1996 |
| JP | 2001-200287 | A | 7/2001 |

OTHER PUBLICATIONS

Lubricants and Lubrication, Wiley-VCH, 2005, p. 16-18, 92, 167-168.*
English language abstract for EP 0565487 extracted from espacenet.com database, dated Aug. 13, 2010, 64 pages.
English equivalent for Japanese Appln. JP 47-002211, no English language translation available, extracted from PAJ database, dated Aug. 13, 2010, 10 pages.
English equivalent for Japanese Appln. JP 48-16881, no English language translation available, extracted from PAJ database, dated Aug. 13, 2010, 9 pages.
English language abstract for JP 58-29898 extracted from espacenet.com database, dated Aug. 13, 2010, 8 pages.
English language abstract for JP 61-103995 extracted from espacenet.com database, dated Aug. 13, 2010, 7 pages.
English language abstract for JP 61-254540 extracted from espacenet.com database, dated Aug. 13, 2010, 5 pages.
English language translation and abstract for JP 08-239683 extracted from PAJ database, dated Aug. 13, 2010, 47 pages.
English language translation and abstract for JP 2001-200287 extracted from PAJ database, dated Aug. 13, 2010, 29 pages.
Article: "Lubricants & Lubrication", Wiley—VCH, p. 16-18, 92, 167-168.
PCT International Search Report for PCT/EP02/12681, dated Apr. 22, 2003, 2 pages.

* cited by examiner

*Primary Examiner* — Jim Goloboy
(74) *Attorney, Agent, or Firm* — Howard & Howard Attorneys PLLC

(57) ABSTRACT

The present invention relates to an aqueous functional fluid comprising an antioxidant of the hindered phenol type and a water-soluble polyalkylene glycol. The aqueous functional fluids are especially suitable for use as hydraulic or metal working fluids. The present invention also relates to the use of the aqueous functional fluid for improving the performance properties of hydraulic or metal working fluids.

4 Claims, No Drawings

AQUEOUS FUNCTIONAL FLUIDS WITH ANTIOXIDANTS

This application is a continuation of application Ser. No. 10/496,234, filed on May 19, 2004 now abandoned which is the National Stage of International Application PCT/EP02/12681, filed Nov. 13, 2002, the contents of which are herein incorporated by reference.

The invention relates to aqueous functional fluids comprising 4-hydroxyphenylpropionic acid esters and water-soluble polyalkylene glycols and to the use of these aqueous functional fluids for improving the performance properties of metalworking fluids or hydraulic fluids.

Additives are added to functional fluids, such as hydraulic or metal working fluids, in order to improve the antioxidative properties of the fluid or to comply with demanding technical and ecological requirements, such as high load-carrying capacity or protection against corrosion and wear. Zinc dialkyl dithiophosphates are commonly used, but due to environmental reasons, various attempts have been made to replace these compounds with metal-free compounds. The use of metal-free hydraulic fluids is mandatory, especially in agricultural machinery or generally in mobile hydraulic units, where leakages present the ecological risk of contamination of soil or water with zinc compounds. Therefore, there is a need for metal-free and ashless additives. Suitable hydraulic fluids should also comply with the specifications of the leading hydraulic machine manufacturers, for example Denison HFO (Denison Hydraulics) or Vickers M-2980-S (Vickers), and need to be compatible with water. In addition, in accordance with the specifications of DIN 51524 and Denison HFO, they should achieve a failure load stage (FLS) of at least 10 in the FZG test.

U.S. Pat. No. 5,531,911 discloses zinc-free hydraulic fluids based on oil that comprise phosphorus- and sulphur-containing additive components. One component is a thiophosphoric acid ester of the triphenylthiophosphate type, e.g. Irgalube® (trade mark of Ciba Specialty Chemicals) TPPT. This component is combined with dithiophosphoric acid esters of the IRGALUBE 63 type and with other optional oil additive components, for example ammonium sulphonates.

A disadvantage of oily formulations is their flammability, especially at higher working temperatures of the machinery employed. Fire resistant hydraulic fluids are mandatory in many applications to minimise the problems associated with leaks of hydraulic fluid from high pressure lines coming in contact with hot equipment, e.g. welding machines, machine tools or die casting machines in the automotive and steel industries.

Further disadvantages of oily formulations relate to the high costs of waste disposal of used oily liquids and the lack of compatibility with water. The contamination of hydraulic oils with water occurs frequently, especially when mobile hydraulic units are used. The presence of phosphorus and sulphur containing additives causes hydrolytic degradation with subsequent formation of corrosive decomposition products. They may attack the metals used in the hydraulic units, e.g. steel and copper alloys, and cause damage to hydraulic pumps. In addition, agglomerations of decomposition products may also block the filters of by-pass filtration units. It is known that the service life of hydraulic units can be significantly extended by means of very fine filtering. Therefore, the filter pore sizes of by-pass filtration units have been reduced from 30μ to 6μ. Consequently, only hydraulic oils that form only extremely small amounts of insoluble hydrolytic decomposition products when contaminated with water can efficiently be used.

Hydraulic fluids having water as a base are disclosed in U.S. Pat. Nos. 4,151,059 and 4,138,346. While hydraulic fluids of any type are primarily used to transmit forces, fluids additionally have to provide lubrication of the mechanical parts of the equipment in order to prevent excessive wear.

Driven by environmental, economic and safety aspects the use of water based fluids, instead of neat oils, is also recommended for quenching and cooling operations in metal working processes. One type of fluids that satisfy these requirements is polyalkylene glycols combined with water in various proportions. Due to the relatively high temperatures involved in the quenching process, the polyalkylene glycols are degraded by oxidation. To overcome this problem, various antioxidants have been proposed.

According to U.S. Pat. No. 4,686,058 high viscosity water hydraulic fluids are prepared by blending water, organic thickeners, such as polyoxyalkylene polyols, and conventional hydraulic fluid additives, such as hindered phenols.

The problem underlying the present invention is the preparation of aqueous functional fluids useful as hydraulic or metal working fluids that have improved compatibility with water and a significantly lower tendency to form undesirable oxidation and hydrolysis products.

It has surprisingly been found that the addition of a suitable antioxidant of the hindered phenol type to an aqueous fluid comprising water soluble polyalkylene glycol or mixtures thereof produces compositions that meet the above-mentioned specifications and have a significantly lower tendency to form corrosive hydrolysis products.

Therefore, the present invention relates to a functional fluid comprising a) A 4-hydroxyphenylpropionic acid ester:

(I)

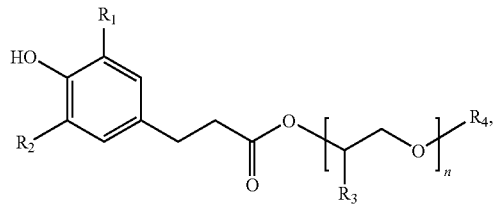

wherein one of $R_1$ and $R_2$ represents hydrogen or $C_1$-$C_9$alkyl; and the other one represents $C_3$-$C_9$alkyl;

$R_3$ represents hydrogen or methyl;

$R_4$ represents hydrogen, $C_1$-$C_{30}$alkyl, $(C_1$-$C_4$alkyl$)_{1-3}$phenyl, phenyl or the group:

(A)

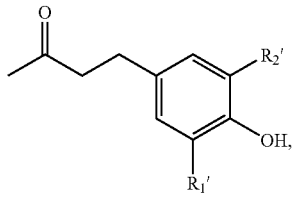

wherein $R_1'$ and $R_2'$ have the same meanings as $R_1$ and $R_2$ defined above; and n represents a numeral from 1 to 60;

b) Water soluble polyalkylene glycol or mixtures thereof; and c) Water.

The aqueous functional fluids are especially suitable for use as hydraulic or metal working fluids. Therefore, the present invention also relates to the use of the aqueous functional fluid defined above for improving the performance properties of hydraulic or metal working fluids.

These fluids are substantially ashless and metal free and meet the above-mentioned specifications.

The terms and definitions used in the context of the description of the present invention preferably have the following meanings:

Component a)

In a compound (I) $R_1$ and $R_2$ defined as $C_1$-$C_9$alkyl comprise unbranched and branched (where possible) groups, for example methyl, ethyl, isopropyl, n-butyl, isobutyl, tert-butyl, n-pentyl, neopentyl, isopentyl, n-hexyl, 2-ethylbutyl, 1-methylpentyl, 1,3-dimethylbutyl, n-heptyl, 3-heptyl, 1-methylhexyl, isoheptyl, n-octyl, 2-ethylhexyl, 1,1,3,3-tetramethylbutyl, 1-methylheptyl, n-nonyl or 1,1,3-trimethylhexyl.

$R_1$ and $R_2$ defined as $C_3$-$C_9$alkyl comprises unbranched and preferably branched groups, e.g. isopropyl, isobutyl, tert-butyl, neopentyl, isopentyl, 2-ethylbutyl, 1-methylpentyl, 1,3-dimethylbutyl, 3-heptyl, 1-methylhexyl, isoheptyl, 2-ethylhexyl, 1,1,3,3-tetramethylbutyl, 1-methylheptyl or 1,1,3-trimethylhexyl.

In a preferred embodiment of the invention one of $R_1$ and $R_2$ represents in a compound (I) hydrogen or $C_1$-$C_9$alkyl, particularly methyl or tert-butyl, and the other one represents $C_3$-$C_9$alkyl, particularly tert-butyl.

$R_4$ defined as $C_1$-$C_{30}$alkyl comprises unbranched and branched (where possible) groups, for example $C_1$-$C_9$alkyl with the above-mentioned meanings, or $C_{10}$-$C_{30}$alkyl, particularly straight chain $C_{19}$-$C_{30}$alkyl, e.g. n-decyl, n-dodecyl, n-tetradecyl, n-hexadecyl or n-octadecyl or higher homologues thereof.

glycol. In a preferred embodiment of the invention, n represents numerals from 2 to 20, particularly numerals from 2 to 15.

A preferred embodiment of the invention relates to an aqueous functional fluid that comprises as component a) a 4-hydroxyphenylpropionic acid ester (I), wherein one of $R_1$ and $R_2$ represents methyl; and the other one represents tert-butyl; or both of $R_1$ and $R_2$ represent tert-butyl;

$R_3$ represents hydrogen or methyl;

$R_4$ represents hydrogen, $C_1$-$C_9$alkyl, or the group (A), wherein one of $R_1'$ and $R_2'$ represents methyl; and the other one represents tert-butyl; or both of $R_1'$ and $R_2'$ represent tert-butyl; and n represents a numeral from 2 to 15.

A particularly preferred embodiment of the invention relates to an aqueous functional fluid that comprises as component a) a compound:

(I')

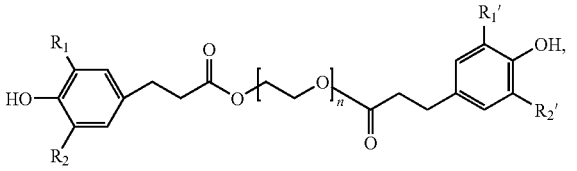

wherein one of $R_1$ and $R_2$ represents methyl and the other one represents tert-butyl;

$R_1'$ and $R_2'$ are as defined as $R_1$ and $R_2$; and the index n represents a numeral from 2 to 15;

or $R_1$, $R_1'$, $R_2$ and $R_2'$ represent tert-butyl; and the index n represents a numeral from 2 to 15.

In a particularly preferred embodiment of the invention the aqueous functional fluid comprises as component a) a compound:

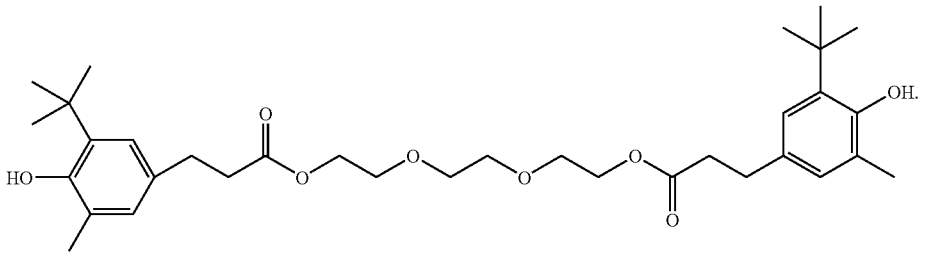

$R_4$ defined as $(C_1$-$C_4$alkyl$)_{1-3}$-phenyl comprises phenyl that is substituted by 1 to 3 $C_1$-$C_4$alkyl groups, e.g. methyl or tert-butyl.

In the group (A) $R_1'$ and $R_2'$ have the same definitions as $R_1$ and $R_2$ defined above. In a preferred embodiment of the invention one of $R_1'$ and $R_2'$ represents in a group (A) hydrogen or $C_1$-$C_9$alkyl, particularly methyl, and the other one represents $C_3$-$C_9$alkyl, particularly tert-butyl. According to another preferred embodiment of the invention both $R_1'$ and $R_2'$ represent in a group (A) $C_3$-$C_9$alkyl, particularly tert-butyl.

In a compound (I) the index n represents a numeral from 1 through 60 and defines the number of repeating units derived from ethylene or propylene oxide or ethylene or propylene The compounds (I) are known and can be produced by known methods, such as the ones described in U.S. Pat. Nos. 4,032,562 and 5,696,281.

Component a) is present in the composition in an amount from 0.002 to 10.0%, preferably 0.002 to 5.0%, and most preferably 0.002 to 1.0%, based on the total weight of the composition.

Component a) is present in the concentrate described below in an amount from 0.01 to 10.0%, preferably 0.02 to 5.0%, and most preferably 0.01 to 2.0%, based on the total weight of the composition.

Component b)

Polyalkylene glycol (polyalkylene oxides) or mixtures thereof are derived from polyethylene glycol or polypropylene glycol (=polyethylene oxide or polypropylene oxide) or mixed polymerisates thereof and are represented by the formula

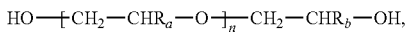

(II)

wherein n is a numeral from 1 to about $1.0\times10^6$ and $R_a$ and $R_b$ represent hydrogen or methyl. Suitable water soluble polyalkylene glycol (polyalkylene oxides) or mixtures thereof are used as heat transfer fluids in the plastics industry and in the reflowing of printed circuit boards at temperatures of 200° C. to 240° C. They show improved performance over petroleum oils or non-aqueous solutions of polyethylene glycols because of their good thermal and oxidative stability, good heat transfer characteristics, high flash points, low tendency to sludge formation, non staining behaviour or low pour point.

Particularly preferred are high viscosity polyalkylene glycols that meet the following specifications:

Viscosity range according to ASTM D445 at 40° C. between 10 000 and 200 000 (cSt) and at 100° C. between 1 000 and 180 000;

Pour point according to ASTM D97 between 0° C. and 20° C.;

Flash point (open cup) above 200° C.;

Cloud point between 50-80° C.

Suitable water-soluble polyalkylene glycols are commercially available from ICI Corp. under the product name Emkarox® (Trademark ICI Corp.), particularly the specific products EMKAROX HV 19, 20, 26, 45, 105, 165.

Component b) is present in the composition in an amount from 0.5 to 95.0%, preferably 0.5 to 75.0%, and most preferably 0.1 to 50.0%, based on the total weight of the composition.

Component b) is present in the concentrate described below in an amount from 5.0 to 95.0%, preferably 10.0 to 90.0%, and most preferably 10.0 to 50.0%, based on the total weight of the composition.

Component c)

The functional fluids contain about 60.0 to 99.0% water and about 40.0 to 1.0% concentrate. Preferably, the fluids contain about 75.0 to 99.0% water and about 25.0 to 1.0% concentrate. As a means of reducing corrosion, the pH of the fluid is maintained above 7. The fluids are easily formulated using tap water although distilled or deionised water is preferred.

Component d)

The addition of at least one additional additive to the functional fluid is optional but preferred. Therefore, the invention also relates to an aqueous functional fluid comprising a) A 4-hydroxyphenylpropionic acid ester (I');

b) High viscosity, water soluble polyalkylene glycol or mixtures thereof;

c) Water; and, optionally, d) Further additives suitable for aqueous hydraulic or metal working fluids.

The above-mentioned functional fluids, e.g. metal-working fluids or hydraulic fluids, may additionally comprise further additives that are added in order to improve their basic properties still further. Such additives include: further antioxidants, metal passivators, corrosion inhibitors, pour-point depressants, dispersants, detergents, further extreme-pressure additives and anti-wear additives. Such additives are added in the amounts customary for each of them, which range in each case approximately from 0.01 to 10.0%, preferably 0.1 to 1.0% by weight. Examples of further additives are given below:

1 Phenolic Antioxidants 1.1 Alkylated Monophenols 2,6-Di-tert-butyl-4-methylphenol, 2-butyl-4,6-dimethylphenol, 2,6-di-tert-butyl-4-ethylphenol, 2,6-di-tert-butyl-4-n-butylphenol, 2,6-di-tert-butyl-4-isobutylphenol, 2,6-dicyclopentyl-4-methylphenol, 2-(α-methylcyclohexyl)-4,6-dimethylphenol, 2,6-dioctadecyl-4-methylphenol, 2,4,6-tricyclohexylphenol, 2,6-di-tert-butyl-4-methoxymethylphenol, linear nonylphenols or nonylphenols branched in the side chain, such as 2,6-dinonyl-4-methylphenol, 2,4-dimethyl-6-(1'-methylundec-1'-yl)-phenol, 2,4-dimethyl-6-(1'-methylheptadec-1'-yl)phenol, 2,4-dimethyl-6-(1'-methyltridec-1'-yl)-phenol and mixtures thereof.

1.2 Alkylthiomethylphenols 2,4-Dioctylthiomethyl-6-tert-butylphenol, 2,4-dioctylthiomethyl-6-methylphenol, 2,4-dioctylthiomethyl-6-ethylphenol, 2,6-didodecylthiomethyl-4-nonylphenol.

1.3 Hydroquinones and Alkylated Hydroquinones 2,6-Di-tert-butyl-4-methoxyphenol, 2,5-di-tert-butylhydroquinone, 2,5-di-tert-amylhydroquinone, 2,6-diphenyl-4-octadecyloxyphenol, 2,6-di-tert-butylhydroquinone, 2,5-di-tertbutyl-4-hydroxyanisole, 3,5-di-tert-butyl-4-hydroxyanisole, 3,5-di-tert-butyl-4-hydroxyphenyl stearate, bis(3,5-di-tert-butyl-4-hydroxyphenyl) adipate.

1.4 Tocopherols

α-, β-, γ- or δ-Tocopherol and mixtures thereof (vitamin E).

1.5 Hydroxylated Thiodiphenyl Ethers 2,2'-Thio-bis(6-tert-butyl-4-methylphenol), 2,2'-thio-bis(4-octylphenol), 4,4'-thio-bis(6-tert-butyl-3-methylphenol), 4,4'-thio-bis(6-tert-butyl-2-methylphenol), 4,4'-thio-bis(3,6-di-secamylphenol), 4,4'-bis(2,6-dimethyl-4-hydroxyphenyl)-disulphide.

1.6 Alkylidene Bisphenols 2,2'-Methylene-bis(6-tert-butyl-4-methylphenol), 2,2'-methylene-(6-tert-butyl-4-ethylphenol), 2,2'-methylene-bis[4-methyl-6-(α-methylcyclohexyl)phenol], 2,2'-methylene-bis(4-methyl-6-cyclohexylphenol), 2,2'-methylene-bis(6-nonyl-4-methylphenol), 2,2'-methylene-bis(4,6-di-tert-butylphenol), 2,2'-ethylidenebis(4,6-di-tert-butylphenol), 2,2"-ethylidene-bis(6-tert-butyl-4-isobutylphenol), 2,2'-methylene-bis[6-(α-methylbenzyl)-4-nonylphenol], 2,2'-methylene-bis[6-(α, α-dimethylbenzyl)-4-nonylphenol], 4,4'-methylene-bis(2,6-di-tert-butylphenol), 4,4'-methylene-bis(6-tert-butyl-2-methylphenol), 1,1-bis(5-tert-butyl-4-hydroxy-2-methylphenyl)butane, 2,6-bis(3-tert-butyl-5-methyl-2-hydroxybenzyl)-4-methylphenol, 1,1,3-tris(5-tert-butyl-4-hydroxy-2-methylphenyl)butane, 1,1-bis(5-tert-butyl-4-hydroxy-2-methylphenyl)-3-n-dodecylmercaptobutane, ethylene glycol bis[3,3-bis(3'-tert-butyl-4'-hydroxyphenyl)butyrate], bis(3-tert-butyl-4-hydroxy-5-methylphenyl)dicyclopentadiene, bis[2-(3'-tert-butyl-2'-hydroxy-5'-methylbenzyl)-6-tert-butyl-4-methylphenyl]-terephthalate, 1,1-bis(3,5-dimethyl-2-hydroxyphenyl) butane, 2,2-bis(3,5-di-tert-butyl-4-hydroxyphenyl)propane, 2,2-bis(5-tert-butyl-4-hydroxy-2-methylphenyl)-4-n-dodecylmercaptobutane, 1,1,5,5-tetra(5-tert-butyl-4-hydroxy-2-methylphenyl)pentane.

1.7 O-, N- and S-Benzyl Compounds 3,5,3',5'-Tetra-tert-butyl-4,4'-dihydroxydibenzyl ether, octadecyl-4-hydroxy-3,5-dimethylbenzyl-mercaptoacetate, tridecyl-4-hydroxy-3,5-di-tert-butylbenzyl-mercaptoacetate, tris(3,5-di-tert-butyl-4-hydroxybenzyl) amine, bis(4-tert-butyl-3-hydroxy-2,6-dimethylbenzyl) dithioterephthalate, bis(3,5-di-tert-butyl-4-hydroxybenzyl) sulphide, isooctyl-3,5-di-tert-butyl-4-hydroxybenzyl-mercaptoacetate.

1.8 Hydroxybenzylated Malonates

Dioctadecyl-2,2-bis(3,5-di-tert-butyl-2-hydroxybenzyl) malonate, dioctadecyl-2-(3-tert-butyl-4-hydroxy-5-methylbenzyl) malonate, didodecylmercaptoethyl-2,2-bis (3,5-di-tert-butyl-4-hydroxybenzyl) malonate, di-[4-(1,1,3,3-tetramethylbutyl)-phenyl]-2,2-bis(3,5-di-tertbutyl-4-hydroxybenzyl) malonate.

1.9 Hydroxybenzyl Aromatic Compounds 1,3,5-tris(3,5-Di-tert-butyl-4-hydroxybenzyl)-2,4,6-trimethylbenzene, 1,4-bis(3,5-di-tertbutyl-4-hydroxybenzyl)-2,3,5,6-tetramethylbenzene, 2,4,6-tris(3,5-di-tert-butyl-4-hydroxybenzyl)phenol.

1.10 Triazine Compounds 2,4-bis-Octylmercapto-6-(3,5-di-tert-butyl-4-hydroxyanilino)-1,3,5-triazine, 2-octylmercapto-4,6-bis(3,5-di-tert-butyl-4-hydroxyanilino)-1,3,5-triazine, 2-octylmercapto-4,6-bis(3,5-di-tert-butyl-4-hydroxyphenoxy)-1,3,5-triazine, 2,4,6-tris(3,5-di-tert-butyl-4-hydroxyphenoxy)-1,2,3-triazine, 1,3,5-tris(3,5-di-tert-butyl-4-hydroxybenzyl) isocyanurate, 1,3,5-tris(4-tert-butyl-3-hydroxy-2,6-dimethylbenzyl)isocyanurate, 2,4,6-tris(3,5-di-tert-butyl-4-hydroxyphenylethyl)-1,3,5-triazine, 1,3,5-tris(3,5-di-tert-butyl-4-hydroxyphenylpropionyl) hexahydro-1,3,5-triazine, 1,3,5-tris(3,5-dicyclohexyl-4-hydroxybenzyl)isocyanurate.

1.11 Acylaminophenols

4-Hydroxylauric acid anilide, 4-hydroxystearic acid anilide, N-(3,5-di-tert-butyl-4-hydroxyphenyl)-carbamic acid octyl ester.

1.12 Esters of β-(5-tert-butyl-4-hydroxy-3-methylphenyl) propionic acid

With polyhydric alcohols, e.g. with 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl)isocyanurate, tris(hydroxyethyl)oxalic acid diamide, 3-thiaundecanol, 3-thiapentadecanol, trimethylhexanediol, trimethylolpropane, 4-hydroxymethyl-1-phospha-2,6,7-trioxabicyclo[2.2.2]octane.

1.13 Esters of β-(3,5-di-tert-butyl-4-hydroxyphenyl) propionic acid, O-(3,5-dicyclohexyl-4-hydroxyphenyl)propionic acid, 3,5-di-tert-butyl-4-hydroxyphenylacetic acid With mono- or polyhydric alcohols, e.g. with methanol, ethanol, n-octanol, isooctanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris (hydroxyethyl)isocyanurate, N,N'-bis-hydroxyethyl oxalic acid diamide, 3-thiaundecanol, 3-thiapentadecanol, trimethylhexanediol, trimethylolpropane, 4-hydroxymethyl-1-phospha-2,6,7-trioxabicyclo[2.2.2]octane.

1.14 Amides of β-(3,5-di-tert-butyl-4-hydroxyphenyl)propionic acid

N,N'-bis(3,5-Di-tert-butyl-4-hydroxyphenylpropionyl) hexamethylenediamine, N,N'-bis(3,5-di-tert-butyl-4-hydroxyphenylpropionyl)trimethylenediamine, N,N'-bis(3,5-di-tert-butyl-4-hydroxyphenylpropionyl) hydrazine.

1.15 Ascorbic Acid (Vitamin C)

1.16 Aminic Antioxidants

N,N'-Diisopropyl-p-phenylenediamine, N,N'-di-sec-butyl-p-phenylenediamine, N,N'-bis(1,4-dimethylpentyl)-p-phenylenediamine, N,N'-bis(1-ethyl-3-methylpentyl)-p-phenylenediamine, N,N'-bis(1-methylheptyl)-p-phenylenediamine, N,N' dicyclohexyl-p-phenylenediamine, N,N'-diphenyl-p-phenylenediamine, N,N'-di-(naphth-2-yl)-p-phenylenediamine, N-isopropyl-N'-phenyl-p-phenylenediamine, N-(1,3-dimethylbutyl)-N'-phenyl-p-phenylenediamine, N-(1-methylheptyl)-N'-phenyl-p-phenylenediamine, N-cyclohexyl-N'-phenyl-p-phenylenediamine, 4-(p-toluenesulfonamido)-diphenylamine, N,N'-dimethyl-N,N'-di-sec-butyl-phenylenediamine, diphenylamine, N-allyldiphenylamine, 4-isopropoxydiphenylamine, 4-n-butylaminophenol, 4-butyrylaminophenol, 4-nonanoylaminophenol, 4-dodecanoylaminophenol, 4-octadecanoylaminophenol, di-(4-methoxyphenyl) amine, 2,6-di-tert-butyl-4-dimethylaminomethyl phenol, 2,4'-diaminodiphenylmethane, 4,4'-diaminodiphenylmethane, N,N,N',N'-tetramethyl-4,4'-diaminodiphenylmethane, 1,2-di[(2-methylphenyl) amino]ethane, 1,2-diphenylaminopropane, o-tolylbiguanide, di-[4-(1,3'-dimethylbutyl)phenyl] amine, tert-octylated N-phenyl-1-naphthylamine, mixture of mono- and di-alkylated tert-butyl/tert-octyl-diphenylamines, mixture of mono- and di-alkylated nonyldiphenylamines, mixture of mono- and di-alkylated dodecyldiphenylamines, mixture of mono- and di-alkylated isopropyl/isohexyl-diphenylamines, mixtures of mono- and di-alkylated tert-butyldiphenylamines, 2,3-dihydro-3,3-dimethyl-4H-1,4-benzothiazine, phenothiazine, mixture of mono- and di-alkylated tert-butyl/tert-octyl-phenothiazines, mixtures of mono- and di-alkylated tert-octylphenothiazines, N-allylphenothiazine, N,N,N',N'-tetraphenyl-1,4-diaminobut-2-ene, N,N-bis(2,2,6,6-tetramethylpiperidin-4-yl)hexamethylenediamine, bis(2,2,6,6-tetramethylpiperidin-4-yl)sebacate, 2,2,6,6-tetramethylpiperidin-4-one, 2,2,6,6-tetramethylpiperidin-4-ol.

2. Further Antioxidants

Aliphatic or aromatic phosphites, esters of thiodipropionic acid or thiodiacetic acid or salts of dithiocarbamic acid, 2,2,12,12-tetramethyl-5,9-dihydroxy-3,7,11-trithiamidecane and 2,2,15,15-tetramethyl-5,12-dihydroxy-3,7,10,14-tetrathiahexadecane.

3 Metal Deactivators (e.g. for Copper)

3.1 Benzotriazoles and Derivatives Thereof

2-Mercaptobenzotriazole, 2,5-dimercaptobenzotriazole, 4- or 5-alkylbenzotriazoles (e.g. tolutriazole) and derivatives thereof, 4,5,6,7-tetrahydrobenzotriazole, 5,5'-methylene-bisbenzotriazole; Mannich bases of benzotriazole or tolutriazole, such as 1-[di-(2-ethylhexyl)aminomethyl]tolutriazole and 1-[di-(2-ethylhexyl)aminomethyl]benzotriazole; alkoxyalkylbenzotriazoles, such as 1-(nonyloxymethyl)benzotriazole, 1-(1-butoxyethyl)-benzotriazole and 1-(1-cyclohexyloxybutyl)-tolutriazole.

3.2 1,2,4-Triazoles and Derivatives Thereof

3-Alkyl- (or -aryl-) 1,2,4-triazoles, Mannich bases of 1,2,4-triazoles, such as 1-[di-(2-ethylhexyl)aminomethyl]-1,2,4-triazole; alkoxyalkyl-1,2,4-triazoles, such as 1-(1-butoxyethyl)-1,2,4-triazole; acylated 3-amino-1,2,4-triazoles.

3.3 Imidazole Derivatives 4,4'-Methylene-bis(2-undecyl-5-methyl) imidazole and bis[(N-methyl)imidazol-2-yl]-carbinol-octyl ether.

3.4 Sulphur-Containing Heterocyclic Compounds

2-Mercaptobenzothiazole, 2,5-dimercapto-1,3,4-thiadiazole, 2,5-dimercaptobenzothiadiazole and Derivatives Thereof; 3,5-bis[di-(2-ethylhexyl)aminomethyl]-1,3,4-thiadiazolin-2-one.

3.5 Amino Compounds

Salicylidene-propylenediamine, salicylaminoguanidine and salts thereof.

4. Corrosion Inhibitors 4.1 Organic Acids, their Esters, Metal Salts, Amine Salts and Anhydrides Alkyl- and alkenyl-succinic acids and their partial esters with alcohols, diols or hydroxycarboxylic acids, partial amides of alkyl- and alkenyl-succinic acids, 4-nonylphenoxyacetic acid, alkoxy- and alkoxyethoxy-carboxylic acids, such as dodecyloxyacetic acid, dodecyloxy (ethoxy)acetic acid and amine salts thereof, and also N-oleoyl-sarcosine, sorbitan monooleate, lead naphthenate, alkenylsuccinic acid anhydrides, e.g. dodecenylsuccinic acid anhydride, 2-(2-carboxyethyl)-1-dodecyl-3-methylglycerol and salts thereof, especially sodium and potassium triethanolamine salts thereof.

4.2 Nitrogen-Containing Compounds

Tertiary aliphatic or cycloaliphatic amines and amine salts of organic and inorganic acids, e.g. oil-soluble alkyl ammonium carboxylates, and 1-[N,N-bis(2-hydroxyethyl)amino]-3-(4-nonylphenoxy)propan-2-ol; heterocyclic compounds: substituted imidazolines and oxazolines, e.g. 2-heptadecenyl-1-(2-hydroxyethyl)-imidazoline.

4.3 Sulphur Containing Compounds

Barium dinonylnaphthalene sulphonates, calcium petroleum sulphonates, alkylthio-substituted aliphatic carboxylic acids, esters of aliphatic 2-sulphocarboxylic acids and salts thereof.

5. Viscosity Index Enhancers

Polyacrylates, polymethacrylates, vinylpyrrolidone/methacrylate copolymers, polyvinylpyrrolidones, polybutenes, olefin copolymers, styrene/acrylate copolymers, polyethers.

6. Pour-Point Depressants

Poly(meth)acrylates, ethylene/vinyl acetate copolymers, alkyl polystyrenes, fumarate copolymers, alkylated naphthalene derivatives.

7. Dispersants/Surfactants

Polybutenylsuccinic acid amides or imides, polybutenyl phosphonic acid derivatives, basic magnesium, calcium and barium sulphonates and phenolates.

8. Extreme-Pressure and Anti-Wear Additives

Sulphur- and halogen-containing compounds, e.g. chlorinated paraffins, sulphurised olefins or vegetable oils (soybean oil, rape oil), alkyl- or aryl-di- or -tri-sulphides, benzotriazoles or derivatives thereof, such as bis(2-ethylhexyl)-aminomethyl tolutriazoles, dithiocarbamates, such as methylene-bis-dibutyldithiocarbamate, derivatives of 2-mercaptobenzothiazole, such as 1-[N,N-bis(2-ethylhexyl)aminomethyl]-2-mercapto-1H-1,3-benzothiazole, derivatives of 2,5-dimercapto-1,3,4-thiadiazole, such as 2,5-bis(tert-nonyldithio)-1,3,4-thiadiazole.

9. Coefficient of Friction Reducers

Lard oil, oleic acid, tallow, rape-oil, sulphurised fats, amides, and amines. Further examples are given in EP-A-0 565 487.

10. Special Additives for Use in Water/Oil Metalworking Fluids and Hydraulic Fluids Emulsifiers, e.g. petroleum sulphonates, amines, such as polyoxyethylated fatty amines, non-ionic surface-active substances; buffers, e.g. alkanolamines; biocides, e.g. triazines, thiazolinones, tris-nitromethane, morpholine, sodium pyridenethiol; processing speed improvers, e.g. calcium and barium sulphonates.

The above-mentioned components may be admixed with the above-mentioned components a)-c) in a manner known per se according to prior art methods for preparing hydraulic or metal working fluids. It is also possible to prepare a concentrate or a so-called "additive package" that can be diluted to give the working concentrations for the intended lubricant. Therefore, the invention also relates to a concentrate comprising a) A 4-hydroxyphenylpropionic acid ester (I), wherein $R_1$-$R_4$ and n are as defined above;

b) A high viscosity, water soluble polyalkylene glycol or mixtures thereof; and c) The above-mentioned further additives suitable for aqueous hydraulic or metal working fluids.

The concentrates of the aqueous functional fluids can be made up free of water or contain any desired amount of water, but preferably contain up to 85% by weight of water to increase fluidity and provide ease of blending at the point of use. As pointed out above, these concentrates are diluted with water in the proportion of 1.0:99.0% to 40.0:60.0% to make up the final hydraulic or metal working fluid.

The aqueous functional fluids according to the present invention are transparent liquids being stable over long periods of storage and ambient temperature. In addition, the aqueous functional fluids are oil-free, do not support combustion, are ecologically clean and non-polluting as compared with existing functional fluids based on oil.

Another embodiment of the invention relates to a method for improving the performance properties of an aqueous functional fluid which comprises adding to an aqueous phase a 4-hydroxyphenylpropionic acid ester (I), wherein $R_1$-$R_4$ and n are as defined above.

The examples are intended for the purpose of illustration. Throughout the application, all parts, proportions and percentages are by weight and all temperatures are in degrees centigrade unless otherwise noted.

EXAMPLES

Stabilisation of Hydraulic and Metal Working Fluids with Selected 4-Hydroxyphenylpropionic Acid Esters a) Materials and Methods Induction Temperature Measured Under PDSC Conditions PDSC Test Conditions

| | |
|---|---|
| DSC cell | METTLER DSC27HP |
| Pan | Seiko Instrument Open Sample Pan diameter 5 mm, aluminium |
| Method | Dynamic method |
| Start temperature | 50° C. |
| Heating rate | 5° C./min |
| End temperature | 250° C. |
| Sample size | 2.7 +/− 0.1 mg |
| Gas | Oxygen 50 ml/min, 1 MPa (10 bar) |

Test Compounds

Test Compound 1

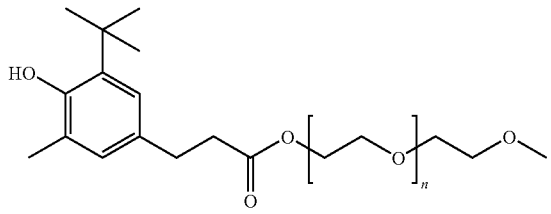

n = 11

Test Compound 2

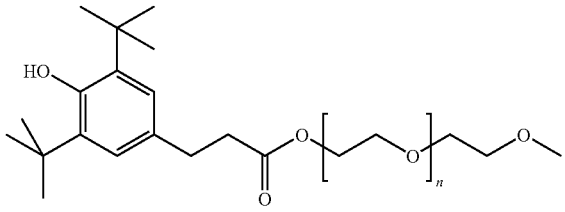

n = 11 b) Results

TABLE

| Example No. | EMKAROX HV45 [%] | Demin. Water [%] | Test Compound 1 [%] | Test Compound 2 [%] | Aspect | Induction Temperature [° C.] |
|---|---|---|---|---|---|---|
| 1 | 80.0 | 20.0 | — | — | — | 146.9 |
| 2 | 79.2 | 19.8 | 1.0 | — | — | 172.7 |
| 3 | 79.2 | 19.8 | — | 1.0 | Clear thick liquid | 158.19 |
| 4 | 60.0 | 40.0 | — | — | — | 137.9 |
| 5 | 59.4 | 39.6 | 1.0 | — | — | 177.8 |
| 6 | 50.0 | 50.0 | — | — | — | 143.2 |
| 7 | 49.5 | 49.5 | 1.0 | — | — | 177.9 |
| 8 | 40.0 | 60.0 | — | — | — | 140.3 |
| 9 | 39.6 | 59.4 | 1.0 | — | — | 180.2 |
| 10 | 20.0 | 80.0 | — | — | — | 135.9 |
| 11 | 19.8 | 79.2 | 1.0 | — | — | 193.2 |
| 12 | 19.8 | 79.2 | — | 1.0 | Hazy | 165.01 |
| 13 | 19.8 | 80.0 | 0.2 | — | Completely clear | 182.14 |

Overall concentration of Test Compound 1 = 0.2 weight %

The invention claimed is:

1. An aqueous functional fluid consisting of a) 0.2 to 1.0 wt. % 4-hydroxyphenylpropionic acid ester (I)

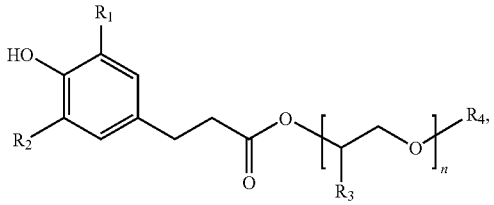

wherein one of $R_1$ and $R_2$ represents methyl or tert-butyl and the other one represents tert-butyl;

$R_3$ represents hydrogen;

$R_4$ represents methyl; and n represents 11;

b) 20 to 80 wt. % water soluble polyalkylene glycol or mixtures thereof having a viscosity range according to ASTM D445 at 40° C. between 40,000 and 55,000 (cSt) and at 100° C. between 7,300 and 7,800 (cSt), pour point according to ASTM D97 of 7° C., flash point (open cup) of 240° C.; and c) water, wherein the wt. % is based on the total weight of the composition.

2. The functional fluid according to claim 1, wherein both of $R_1$ and $R_2$ represent tert-butyl.

3. A method for improving the performance properties of a functional fluid composition consisting of combining a) 0.2 to 1.0 wt. % 4-hydroxyphenylpropionic acid ester (I):

(I)

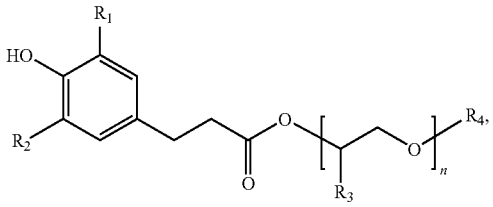

wherein one of $R_1$ and $R_2$ represents methyl or tert-butyl and the other one represents tert-butyl;

$R_3$ represents hydrogen;

$R_4$ represents methyl; and n represents 11;

b) 20 to 80 wt. % water soluble polyalkylene glycol or mixtures thereof having a viscosity range according to ASTM D445 at 40° C. between 40,000 and 55,000 (cSt) and at 100° C. between 7,300 and 7,800 (cSt), pour point according to ASTM D97 of 7° C., flash point (open cup) of 240° C.; and c) water, wherein the wt. % is based on the total weight of the composition.

4. The method according to claim 3 wherein both of $R_1$ and $R_2$ represent tert-butyl.

* * * * *